US006082335A

United States Patent [19]

Kampichler et al.

[11] Patent Number: 6,082,335

[45] Date of Patent: Jul. 4, 2000

[54] FUEL INJECTION PUMP FOR INTERNAL COMBUSTION ENGINES, IN PARTICULAR ONE-CYLINDER DIESEL ENGINES

[75] Inventors: Guenter Kampichler, Ruhstorf; Theodor Tovar, Pocking, both of Germany

[73] Assignee: Motorenfabrik Hatz GmbH & Co. KG., Ruhstorf, Germany

[21] Appl. No.: 09/043,763

[22] PCT Filed: Jul. 23, 1997

[86] PCT No.: PCT/EP97/03985

§ 371 Date: Jun. 24, 1998

§ 102(e) Date: Jun. 24, 1998

[87] PCT Pub. No.: WO98/04827

PCT Pub. Date: Feb. 5, 1998

[30] Foreign Application Priority Data

Jul. 26, 1996 [DE] Germany ..... 196 30 337

[51] Int. Cl.[7] ..... F02M 37/04

[52] U.S. Cl. ..... 123/500; 123/300

[58] Field of Search ..... 123/500, 501, 123/299, 300, 449

[56] References Cited

U.S. PATENT DOCUMENTS

| | | | |
|---|---|---|---|
| 4,163,634 | 8/1979 | Powers . | |
| 4,881,506 | 11/1989 | Hoecker | 123/500 |
| 5,020,979 | 6/1991 | Askew | 123/300 |
| 5,097,812 | 3/1992 | Augustin | 123/500 |
| 5,168,847 | 12/1992 | Greishaber | 123/500 |
| 5,205,262 | 4/1993 | Anton | 123/449 |
| 5,219,280 | 6/1993 | Yashiro | 123/500 |
| 5,286,178 | 2/1994 | Schaef | 123/299 |
| 5,396,871 | 3/1995 | Faupel | 123/500 |
| 5,592,915 | 1/1997 | Ishiwata | 123/300 |
| 5,647,326 | 7/1997 | Kato | 123/500 |

FOREIGN PATENT DOCUMENTS

| | | | |
|---|---|---|---|
| 703 361 | 3/1996 | European Pat. Off. . | |
| 1565939 | 5/1969 | France . | |
| 607 230 | 12/1934 | Germany . | |
| 2906688 | 8/1980 | Germany . | |
| 3424989 | 1/1986 | Germany . | |
| 6257534 | 9/1994 | Japan | 123/500 |
| 269597A | 10/1950 | Switzerland . | |
| 2152155 | 7/1985 | United Kingdom . | |

OTHER PUBLICATIONS

Patent Abstracts of Japan vol. 006, No. 228 (M–171), Nov. 13, 1892.

Patent Abstract of Japan 57 129227 A (Nippon Denso KK), Aug. 11, 1982.

*Primary Examiner*—Carl S. Miller

*Attorney, Agent, or Firm*—Helfgott & Karas, PC

[57] ABSTRACT

A fuel injection pump for internal combustion engines, in particular one-cylinder diesel engines, has a pump piston (1) which can axially slide and rotate in a pump cylinder (13) with at least one fuel suction bore (14), a driving groove (6) arranged on the pump piston (1) parallel to the piston longitudinal axis, and geometrical connection between the front side (4) and the outer surface of the pump piston (1). In order to hydrodynamically regulate the optimum injection beginning during start, idle running and highest speed of rotation, a narrow slot (2,7) is provided as geometrical connection.

16 Claims, 3 Drawing Sheets

FUEL INJECTION PUMP FOR INTERNAL COMBUSTION ENGINES, IN PARTICULAR ONE-CYLINDER DIESEL ENGINES

The invention relates to a fuel-injection pump for injection in combustion machines, especially one-cylinder diesel engines, with a pump piston disposed axially and rotatably movably in a pump cylinder with at least one intake port for fuel, a runback slot disposed on the pump piston and in communication with a stop slot for interruption of fuel delivery, mounted on the pump piston parallel to the longitudinal axis of the piston, and with a geometric connection between the end face and the shell surface of the pump piston, wherein there is provided, in order to exert a hydrodynamic influence on control of the beginning of injection, a narrow transverse slit spaced from the leading edge and running parallel or at an angle thereto and at one end discharging into the stop slot of the pump piston.

Such fuel-injection pumps are already known from the prior art. In diesel combustion machines, especially in such with direct injection, there are usually employed one-piece or block-type insertable pumps in which, because of the compact construction, it is not possible to include any kind of electrical or electronic control signals for correcting the beginning of injection in addition to the control-travel mechanism (control linkage or control rod) and the cam-driven stroke mechanism. None of the known corrections of beginning of injection is feasible without costly mechanical injection actuators to be connected as input or feedforward components to the drive.

For optimum operating values with respect to power, fuel consumption, exhaust-gas and noise emission, the beginning of injection must be advanced at higher speeds in diesel engines. In larger diesel engines, this advance setting is achieved by electronic control or complex mechanical control elements, which are described, for example, in the Bosch pamphlet of 1989 entitled "Technical Instruction: A review of diesel injection techniques" [in German]. This advance setting and the positive effects associated therewith are obviously desirable or necessary even in smaller engines. This is particularly true for starting, especially at low outside temperatures, where retarded beginning of injection is needed for initial ignition and advanced beginning of ignition is needed for subsequent further running and runup without misfiring together with the least possible hydrocarbon emissions as the speed increases. For space and cost reasons, it is not possible in the case of one-cylinder diesel engines to resort to conventional electronic control, which is complex and expensive.

Heretofore, fuel-injection pumps that cause a shift in beginning of injection by means of a chamfer on the head of the pump piston with a circumferential radial depth of about 0.5% of the piston diameter have been used for small diesel engines. Hereby, however, no differentiation between normal operation and starting/runup is possible. A further embodiment comprises a locally limited chamfer defined by a chord and having a depth of about 1.3% of the piston diameter.

DE 3424989 C2 discloses a pump piston used in a fuel-injection pump for combustion machines, by means of the structural geometry of which a reduction of the ignition retardation and thus a reduction of the combustion-pressure peaks is supposed to be achieved in the combustion chamber of the combustion machine to be supplied. For this purpose a circumferential slot which acts over the entire range of rotation of the pump piston is made in the pump piston.

All described embodiments have the disadvantage that the shift of beginning of injection depends greatly on the running play between pump piston and pump cylinder and is not differentiated between the various speed ranges.

The object of the present invention is therefore to provide an inexpensive fuel-injection pump with which improved control of the beginning of injection can be adjusted for starting, idling and top speed by means of hydrodynamic-mechanical control.

This object is achieved according to the invention by a fuel-injection pump with the features of claim 1.

In the fuel-injection pump according to the invention, the pump piston is constructed such that a narrow longitudinal slit running parallel to the pump-piston axis and cut into the circumferential edge is provided, and in that the narrow transverse slit is disposed between the stop slot and the narrow longitudinal slit.

Hereby a compact, inexpensive hydrodynamic control system for starting, idling and top speed is achieved in surprisingly simple manner. This is characterized by low sensitivity even with broad size tolerances or mounting tolerances as well as by wear rates that are considerably better than in the tolerance range known from the prior art, and that thereby contribute substantially to lowering the costs. Furthermore, the fuel pump according to the invention is also characterized by improved control of the beginning of injection. This is due in particular to the speed-dependent action of the slit cross section, which allows more fuel to flow back at low speeds than at higher speeds, at which less time is available for runoff. An almost optimum beginning of injection for every speed can be achieved by taking advantage of this effect. The desired optimization of injection flow in the range of rotation of the pump piston is controlled by the geometric arrangement of the transverse slit.

Because of the simple and inexpensive structural form of the longitudinal slit, the beginning of injection in the starting and runup phase can be hydrodynamically controlled in simple manner when the engine is cold.

The simply and inexpensively made structural arrangement of the narrow transverse slit permits hydrodynamic control in idling, part-load and full-load operation. Furthermore, this design permits a broad tolerance range for manufacturing and operation without noteworthy influence on the characteristic curve of beginning of injection.

A further embodiment according to the invention provides that the first transversely running narrow slit discharges into the second longitudinally running narrow slit.

By this simple and inexpensive structural design of the pump piston, optimum hydrodynamic control for both starting operation and also for idling and full-load operation can be achieved by a mechanical angular adjustment of the piston. Furthermore, output of the highest possible torque over the entire speed range is made possible by this control, and low hydrocarbon emission is ensured. Another substantial advantage compared with the prior art is that further running and runup without misfiring after a cold start is possible in surprisingly simple and inexpensive way. For example, the control can then be exerted by the fact that a control rod actuated by a bimetallic strip positions a control linkage mounted on the pump piston and thereby alters the piston angle or the rotational position of the piston.

An advantageous and efficient embodiment is achieved when the radial depth of the narrow slit is 5 to 10%, preferably 8% of the pump piston diameter.

Such a slit depth permits inexpensive machining by metal-cutting methods in low production volume.

It is also advantageous for the width of the narrow slit to be about 2 to 6%, preferably 4% of the pump piston diameter.

The throttling cross section can be optimized when the slit width is defined in this way.

Finally, it is also advantageous for the piston to have, in idling, part-load and full-load operation, an angular position in which the narrow transverse slit overlaps the intake port during a piston stroke.

In the said operating range, this setting ensures that the throttling cross section varies in precalculated manner with speed and thus adjusts the desired optimum shift of beginning of injection. In this connection, the intake port may have various cross-sectional shapes, such as round hole, ellipse, rhomboid or triangle.

It is also advantageous for the pump piston, during starting operation, to have an angular position in which the narrow longitudinal slit overlaps the intake port during a piston stroke, the axis of the longitudinal slit then passing approximately through the center of the intake port.

This ensures that the throttling cross section is optimum for achieving the desired shift of beginning of injection even in starting operation and during runup when the engine is cold.

A most advantageous embodiment of the present invention is one in which the pump cylinder is constructed in one piece with the timing case.

In this way, only the high-precision fit parts such as pump elements and pressure valves have to be enclosed in the timing case, thus saving costs for the manufacture of an additional pump cylinder as well as space for assembly.

The invention will now be described in more detail on the basis of practical examples together with the attached drawings, wherein:

FIG. 3 shows a perspective view of a further practical example of

Figure 4:
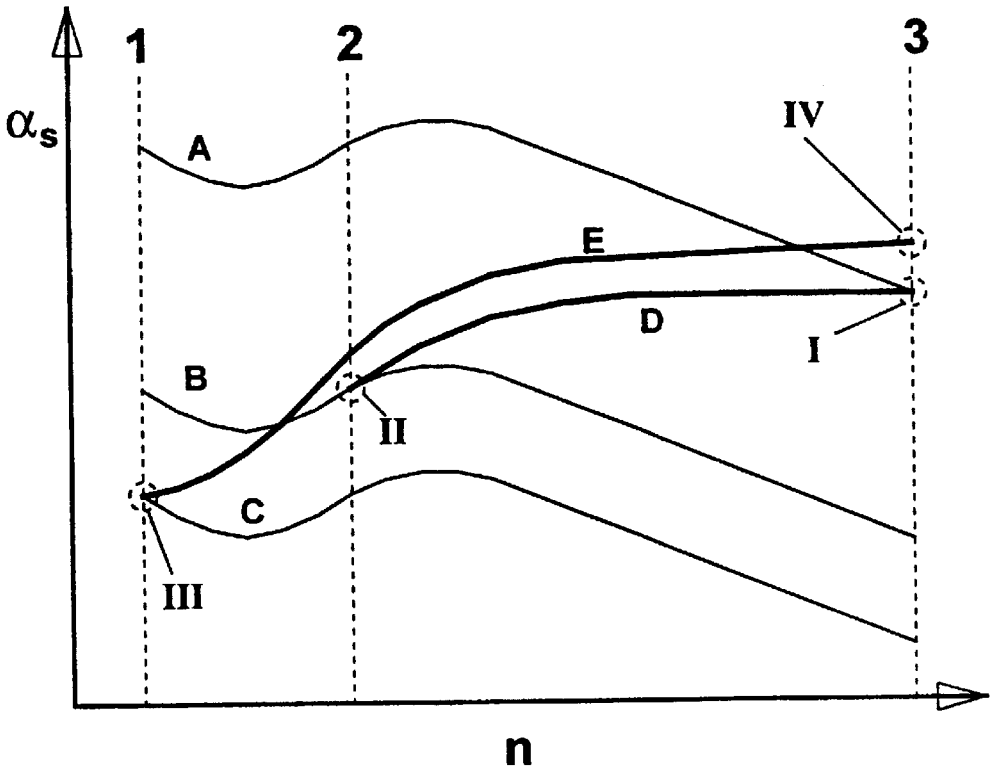
Figure 5:
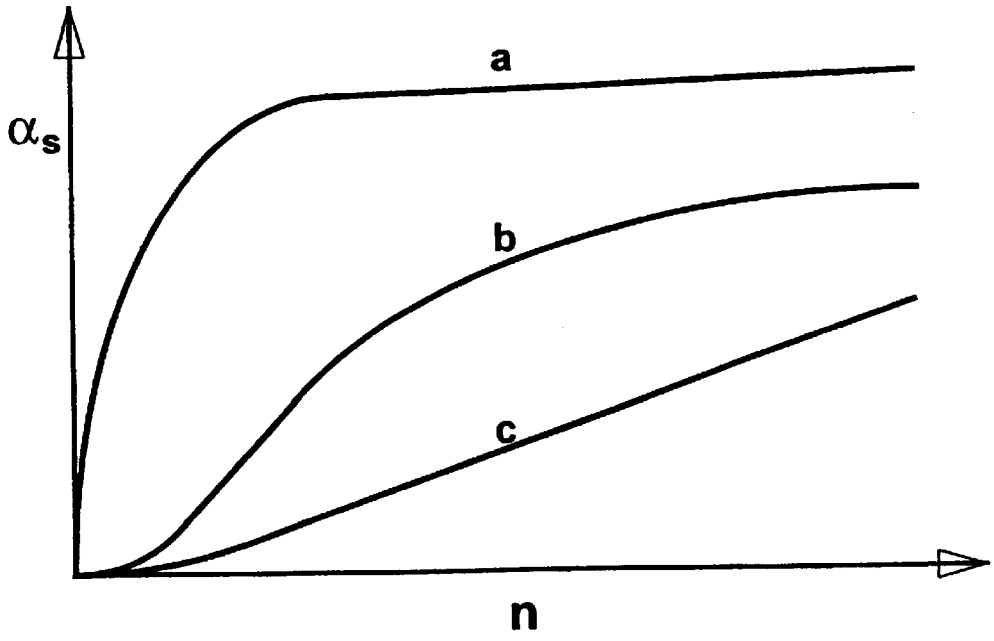

FIG. a pump piston of the type according to the invention;

FIG. 4 shows a diagram of beginning of injection $\alpha_s$ versus engine speed n; and FIG. 5 shows a diagram of beginning of injection $\alpha_s$ versus engine speed n for several throttling cross sections.

Figure 1:
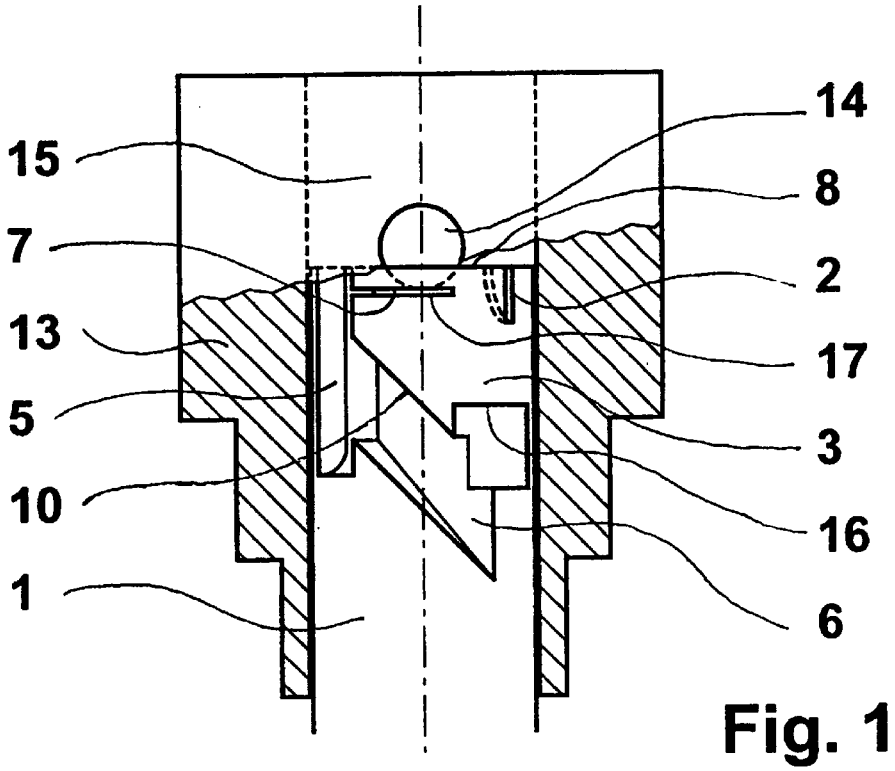
FIG. 1 shows a partial section through a fuel-injection pump of the type according to the invention with a pump piston according to one embodiment in the position for normal operation.

FIG. 1 shows a partial section through a fuel-injection pump according to the invention with a pump piston 1, which is disposed longitudinally and rotatably movably in a pump cylinder 13 having an intake port 14. The pump working chamber 15 is bounded by the cylinder 13 and the end face 4 of the pump piston. The pump piston 1 is further provided on its shell surface 3 with a narrow longitudinal slit 2, a transverse slit 7, stop slot 5 and runback slot 6. Transverse slit 7 is disposed between stop slot 5 and longitudinal slit 2.

The stroke movement of piston 1 is driven by a cam, not shown. The angular position of pump piston 1 is adjusted mechanically by a control rod, not shown, which is designed as a toothed rack and which brings the pump piston into its starting operating position or into the normal operating position shown here by means of an externally toothed control sleeve, also not shown here. The fuel is sucked through intake port 14 into pump working chamber 15 during the downstroke of pump piston 1 and then, after intake port 14 has been closed by the leading edge 4* of pump piston 1, is delivered via a pressure valve, not shown, with injection line to an injection valve, also not shown, during the upstroke. Delivery is ended as soon as oblique runback edge 10 opens intake port 14 and the fuel can flow from pump working chamber 15 via stop slot 5 and runback slot 6 back through intake port 14. In this connection, the spacing between leading edge 4* of pump piston 1 and bottom edge 17 of narrow transverse slit 7 is smaller than the diameter of intake port 14. Consequently, after intake port 14 has been closed by leading edge 4 of pump piston 1, the fuel can flow via stop slot 5 and narrow transverse slit 7 back into intake port 14. Because of the small cross section of narrow slit 7, however, the return flow is throttled. When the bottom edge of narrow slit 7 has reached the top edge of intake port 14 as a result of the piston stroke, the throttled return flow of fuel is ended and delivery is continued in conventional manner. This hydrodynamic effect, namely throttled return flow of fuel, is speed-dependent. Higher speeds result in shorter dwell times of narrow transverse slit 7 in the region of intake port 14, and so less fuel can flow back. This means that pressure buildup upstream from the injection valve takes place faster and thus that the beginning of injection becomes progressively advanced with increasing speed.

*Translator's note: Suspect that "4" should stand for "end face" and "8" for "leading edge".

Figure 2:
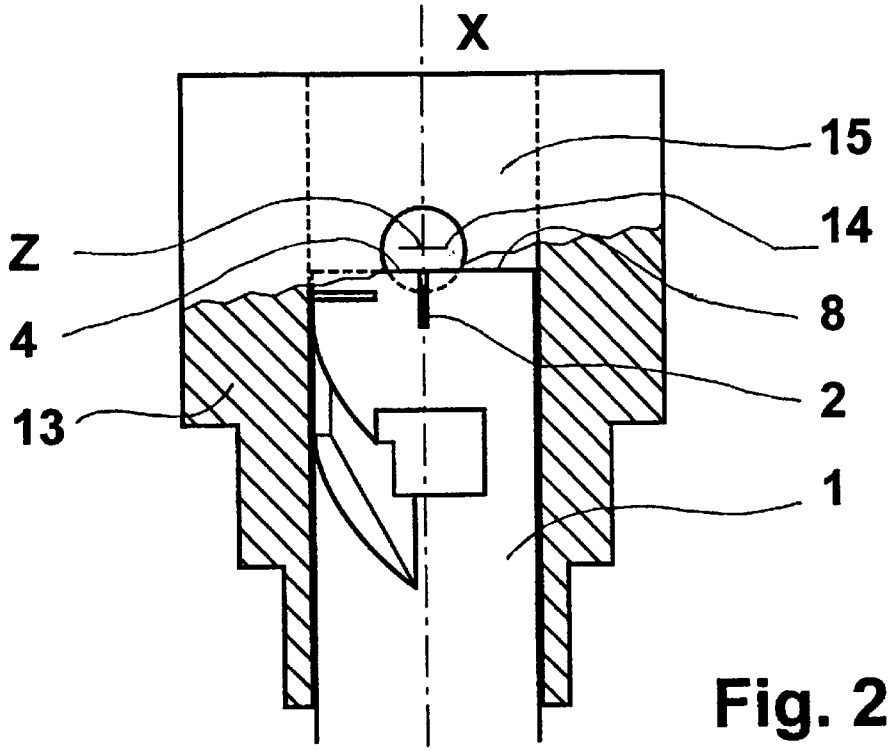
FIG. 2 shows the pump piston according to FIG. 1 in the position for starting operation.

FIG. 2 shows a partial section of the fuel-injection pump according to FIG. 1 in the operating position for starting and runup. In this case pump piston 1 has, inside pump cylinder 13, an angular position in which the centerline X of narrow longitudinal slit 2 passes through the center Z of intake port 14. When the engine is cold, this position of the pump piston is adjusted in conventional mechanical manner, producing retarded beginning of injection for the first ignitions.

In this piston position, intake port 14 and narrow slit 2 overlap during a piston stroke. Once pump piston 1 has closed intake port 14 with leading edge 4 during its upstroke, some of the fuel can flow at throttled rate out of pump working chamber 15 via narrow slit 2 back through intake port 14. The return flowrate depends on speed in this case also, or in other words the beginning of injection becomes progressively advanced with increasing speed. When the bottom edge of narrow longitudinal slit 2 has reached the top edge of intake port 14, the return flow of fuel is ended and delivery again continues in conventional manner. The characteristic of the position of beginning of injection can be influenced by appropriate design of the cross section of slit 2.

Figure 3:
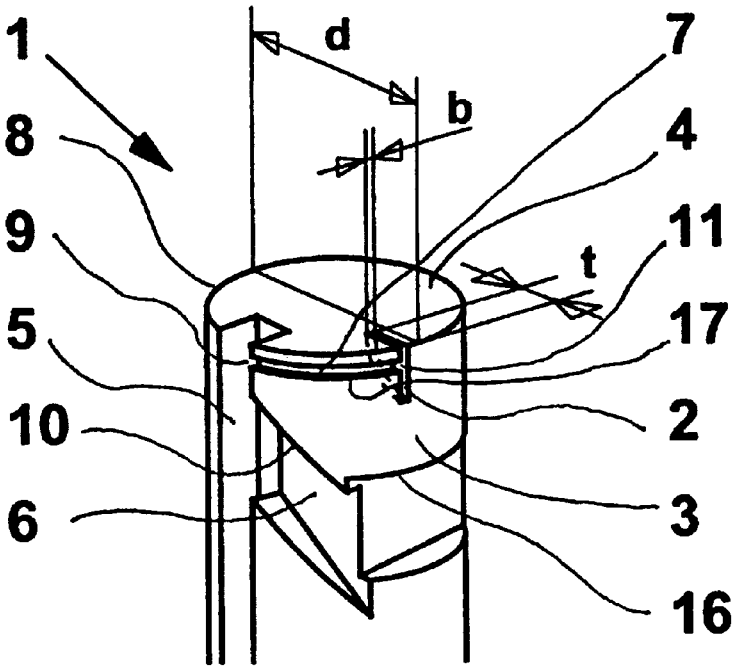

FIG. 3 shows a further practical example of a pump piston according to the invention, which is provided with a narrow longitudinal slit 2 and a narrow transverse slit 7 on shell surface 3. In this case, longitudinal slit 2 extends to the end face 4 of pump piston 1. The distance from bottom edge 17 of transverse slit 7 to leading edge 8 is shorter than the diameter of the intake port. In addition to the hole 9 to stop slot 7, transverse slit 7 is provided with a further hole 11 to narrow slit 2. Transverse slit 7 is therefore again disposed between stop slot and longitudinal slit as is already the case in the practical examples according to FIG. 1 and 2. In the present example, slit width b is 4% of pump piston diameter d and slit width t is 8% of the pump piston diameter. Moreover, runback slot 6 with runback edge 10 is disposed on pump piston 1, as is starting-flow limiting edge 16.

The pump rod illustrated in FIG. 3 can be made in simple manner by machining with metal-cutting tools. Once installed in the pump cylinder, it is driven at the end opposite end face 4 by a cam. The stroke velocity is proportional to the engine speed. The piston is provided with the edges known from the prior art (runback edge 10, starting-flow limiting edge 16) to control starting and normal operation between idling and full load. The additional narrow slits permit high manufacturing tolerances or wear-related tolerances.

FIG. 4 shows a diagram of curves in which the beginning of injection $\alpha_s$ is plotted against engine speed n. Of those, curve A shows the variation in beginning of injection for a conventional pump piston without the narrow slits according to the invention. This piston was adjusted optimally for the top speed 3. Curve B also shows a conventional pump piston, which is optimally adjusted for low speeds 2. Finally, curve C shows the variation in beginning of injection for a conventional pump piston adjusted for starting speed 1. Curve D shows the variation of beginning of injection for the case of use of a piston according to the invention with hydrodynamic shift of the beginning of injection, this piston being tuned to the needs of the engine during normal operation, or in other words between lowest speed 2 and top speed 3 when the engine is hot. From curve D of the beginning of injection, it can be clearly seen that, in the case of use of the pump piston according to the invention, the curve passes through optimum II for lowest speed and through optimum I for top speed when the engine is hot. Furthermore, curve E shows the variation of the beginning of injection for operation from starting through runup (1 to 3 when the engine is cold). In this case of use of the pump piston according to the invention, it is obvious from the diagram that the curve of beginning of injection in this operating condition passes through optimum III for starting and through optimum IV for top speed when the engine is cold.

Curves A, B and C, which correspond to the prior art, exhibit a falling trend on average, whereas curves D and E of the fuel-injection pump according to the invention exhibit a rising trend on average.

FIG. 5 shows a family of curves for beginning of injection $\alpha_s$ versus engine speed n at several throttling cross sections. This is determined by the change in cross section of the narrow slits. Curve a shows the variation of beginning of injection for small throttling cross section, and is characterized by a steep advanced position at low speed and then constant beginning of injection in the remaining speed range, whereas curve c illustrates the variation of beginning of injection for large throttling cross section. Curve b corresponds approximately to the variation of beginning of injection of curves E and D from FIG. 4 and also has a sigmoidal shape. This means retarded beginning of injection in the low speed range and advanced position with increasing engine speed.

We claim:

1. A fuel injection-pump for injection in combustion machines with a pump piston (1), which is disposed axially and rotatably movable in a pump cylinder (13) with at least one intake port (14) for fuel and is provided with a runback slot (16), which is in communication with a stop slot (5) for interruption of fuel delivery, mounted on the pump piston (1) parallel to the longitudinal axis of the piston, and with a geometric connection in the region of the circumferential edge between the top end face and the shell surface (3) of the pump piston (1), wherein there is provided, in order to exert a hydrodynamic influence on control of the beginning of injection, a narrow transverse slit (7) spaced from the leading edge (8) and at one end discharging into the stop slot (5) of the pump piston (1), wherein a narrow longitudinal slit (2) running parallel to the pump-piston axis and cut into the circumferential edge is provided, and the narrow transverse slit is disposed between the stop slot (5) and the narrow longitudinal slit (2).

2. A fuel-injection pump according to claim 1, wherein the transverse slit (7) discharges into the longitudinal slit (2).

3. A fuel injections-pump for injection in combustion machines with a pump piston (1), which is disposed axially and rotatable movable in a pump cylinder (13) with at least one intake port (14) for fuel and is provided with a runback slot (16), which is in communication with a stop slot (5) for interruption of fuel delivery mounted on the pump piston (1) parallel to the longitudinal axis of the piston and with a geometric connection in the region of the circumferential edge between the top end face and the shell surface (3) of the pump piston (1), wherein there is provided, in order to exert a hydrodynamic influence on control of the beginning of injection, a narrow transverse slit (7) spaced from the leading edge (8) and at one end discharging into the stop slot (5) of the pump piston (1), wherein a narrow longitudinal slit (2) running parallel to the pump-piston axis and cut into the circumferential edge is provided, and the narrow transverse slit (7) is disposed between the stop slot (5) and the narrow longitudinal slit (2) the radial depth (t) of the longitudinal narrow slit ranges from 5 to 10% of the pump piston diameter (d).

4. A fuel injection-pump for injection in combustion machines with a pump piston (1), which is disposed axially and rotatably movable in a pump cylinder (13) with at least one intake port (14) for fuel and is provided with a runback slot (16), which is in communication with a stop slot (5) for interruption of fuel delivery mounted on the pump piston (1) parallel to the longitudinal axis of the piston and with a geometric connection in the region of the circumferential edge between the top end face and the shell surface (3) of the pump piston (1), wherein there is provided, in order to exert a hydrodynamic influence on control of the beginning of injection, a narrow transverse slit (7) spaced from the leading edge (8) and at one end discharging into the stop slot (5) of the pump piston (1), wherein a narrow longitudinal slit (2) running parallel to the pump-piston axis and cut into the circumferential edge is provided, and the narrow transverse slit (7) is disposed between the stop slot (5) and the narrow longitudinal slit (2), the width (b) of the narrow longitudinal slit ranges from 2% to 6% of the pump piston diameter (d).

5. A fuel injection-pump for injection in combustion machines with a pump piston (1), which is disposed axially and rotatably movable in a pump cylinder (13) with at least one intake port (14) for fuel and is provided with a runback slot (16), which is in communication with a stop slot (5) for interruption of fuel delivery mounted on the pump piston (1) parallel to the longitudinal axis of the piston, and with a geometric connection in the region of the circumferential edge between the top end face and the shell surface (3) of the pump piston (1), wherein there is provided, in order to exert a hydrodynamic influence on control of the beginning of injection, a narrow transverse slit (7) spaced from the leading edge (8) and at one end discharging into the stop slot (5) of the pump piston (1), wherein a narrow longitudinal slit (2) running parallel to the pump-piston axis and cut into the circumferential edge is provided, and the narrow transverse slit (7) is disposed between the stop slot (5) and the narrow longitudinal slit (2), the pump piston (1) has in idling, part-load, and full-load operation respectively, an angular position in which the narrow transverse slit (7) overlaps the intake port (14) during a piston stroke.

6. A fuel injection-pump for injection in combustion machines with a pump piston (1), which is disposed axially and rotatably movable in a pump cylinder (13) with at least one intake port (14) for fuel and is provided with a runback slot (16), which is in communication with a stop slot (5) for interruption of fuel delivery, mounted on the pump piston (1) parallel to the longitudinal axis of the piston, and with a geometric connection in the region of the circumferential edge between the top end face and the shell surface (3) of the pump piston (1), wherein there is provided, in order to exert a hydrodynamic influence on control of the beginning of injection, a narrow transverse slit (7) spaced from the leading edge (8) and at one end discharging into the stop slot (5) of the pump piston (1), wherein a narrow longitudinal slit (2) running parallel to the pump-piston axis and cut into the circumferential edge is provided, and the narrow transverse slit (7) is disposed between the stop slot (5) and the narrow longitudinal slit (2), the pump piston (1) has during starting operation, an angular position in which the narrow longitudinal slit (2) overlaps the intake port (14) during a piston stroke, the axis of the longitudinal slit (2) then passing approximately through the center of the intake port (14).

7. A fuel-injection pump according to claim 1, characterized in that the pump cylinder is constructed in one piece with the timing case.

8. A fuel injection pump according to claim 1, wherein the narrow transverse slit is parallel to the leading edge.

9. A fuel injection pump according to claim 1, wherein the narrow transverse slit is at an angle to the leading edge.

10. A fuel injection pump according to claim 1 wherein the combustion machine is a one-cylinder diesel engine.

11. A fuel injection pump according to claim 3, wherein the radial depth (t) of the narrow longitudinal slit is 8% of the pump piston diameter.

12. A fuel injection pump according to claim 3, wherein the combustion machine is a one-cylinder diesel engine.

13. A fuel injection pump according to claim 4, wherein the width (b) of the narrow longitudinal slit is 4% of the pump piston diameter.

14. A fuel injection pump according to claim 4, wherein the combustion machine is a one-cylinder diesel engine.

15. A fuel injection pump according to claim 5, wherein the combustion machine is a one-cylinder diesel engine.

16. A fuel injection pump according to claim 6, wherein the combustion machine is a one-cylinder diesel engine.

* * * * *